United States Patent [19]

Dieterle

[11] Patent Number: 4,745,528

[45] Date of Patent: May 17, 1988

[54] LIGHTED TRAVEL MIRROR WITH RETRACTABLE COMBINED BASE SUPPORT AND HANDLE

[75] Inventor: Wayne D. Dieterle, South Plainfield, N.J.

[73] Assignee: Conair Corporation, Edison, N.J.

[21] Appl. No.: 33,673

[22] Filed: Apr. 3, 1987

[51] Int. Cl.[4] ..... F21V 33/00

[52] U.S. Cl. ..... 362/135; 362/109; 362/141

[58] Field of Search ..... 362/109, 135, 136, 137, 362/138, 139, 140, 141, 142, 143, 144; 248/475.1, 471, 472, 473; D28/64.1; D8/354

[56] References Cited

U.S. PATENT DOCUMENTS

| | | | |
|---|---|---|---|
| 1,057,820 | 4/1913 | Gernsback | 362/135 |
| 1,216,724 | 2/1917 | Petrie | 362/135 |
| 1,315,457 | 9/1919 | Benedict | 362/135 |
| 1,638,672 | 8/1927 | Walsh | 248/471 |
| 1,792,127 | 2/1931 | Shulman et al. | 248/471 |
| 2,106,254 | 1/1938 | Newell | 362/142 |
| 2,235,109 | 3/1941 | Morey | 362/135 |
| 4,091,443 | 5/1978 | Ohrenstein et al. | 362/156 |

FOREIGN PATENT DOCUMENTS

| | | | |
|---|---|---|---|
| 2410986 | 8/1979 | France | 248/471 |

*Primary Examiner*—E. Rollins Cross
*Attorney, Agent, or Firm*—Haynes N. Johnson

[57] ABSTRACT

A lighted travel mirror adapted to alternatively stand alone or be hand held including a housing with a pair of side lights, a reflective surface on one surface, a side having a lower edge, and an elongate recess opening to the housing along the lower edge. The recess includes slots upon opposing sides to receive a base support slidingly and frictionally mounted in the recess, and the support includes pivot arms at its inner end with the pivot arms being operatively engaged with the slots. The result is a mirror with a base support which can be alternatively stored within the recess or withdrawn from the recess and pivoted so as to form a stable T-shaped base for the mirror.

4 Claims, 2 Drawing Sheets

LIGHTED TRAVEL MIRROR WITH RETRACTABLE COMBINED BASE SUPPORT AND HANDLE

FIELD OF THE INVENTION

This invention relates to the field of compact, lighted travel mirrors and, in particular, to such mirrors having a retractable combined base and handle which provides enhanced stability.

BACKGROUND OF THE INVENTION

There are, of course, various designs for lighted mirrors. These would include ones such as in Southam U.S. Pat. No. 856,497; Herbold U.S. Pat. No. 1,968,342; and Wickwire U.S. Pat. No. 2,480,800. Ones having batteries in their handles include Gernsback U.S. Pat. No. 1,057,820; Petrie U.S. Pat. No. 1,216,724; and Lustig Fr. Pat. No. 1,038,015. Some show an effort to recess a handle, though not necessarily within the mirror, such as Maurud U.S. Pat. No. 2,275,304 and Wickwire U.S. Pat. No. 2,480,800.

However, the prior art does not appear to show a mirror in which the base support may slidingly recess into the mirror housing and, when withdrawn, pivot to form a stable "T" base for the mirror, or alternatively, be used as a handle.

BRIEF SUMMARY OF THE INVENTION

A small travel mirror is provided having an internal recess adapted to slidingly receive and hold a pivoted base support. The base support is adapted to slide within the recess for storage or travel and to be withdrawn from the recess for use. The inner end of the base support includes extending pivot arms which, when the support is withdrawn, interengage with the mirror housing to provide a frictional pivot point so that the support may be used to support the mirror on a "T" base. Alternatively, detents may be used to hold the base support at any desired angle relative to the mirror.

The mirror houses lights on each side and batteries for the lights positioned within its housing.

The base support may also be used as a handle by withdrawing it from the mirror housing but not pivoting it.

DETAILED DESCRIPTION OF THE INVENTION

Figure 1:
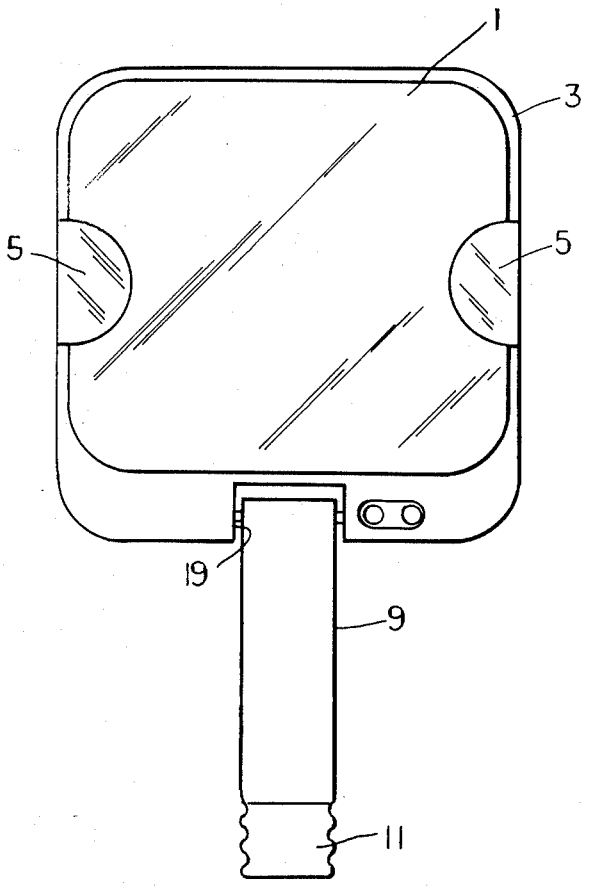
FIG. 1 is a front elevation of my mirror showing the base support extended and positioned for use as a handle.
Figure 2:
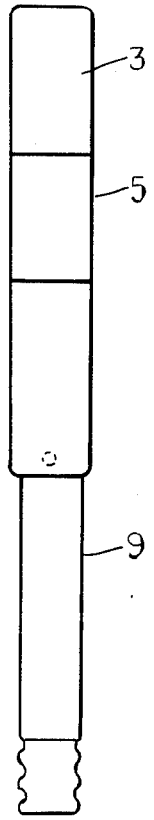
FIG. 2 is a side elevation of the same structure.
Figure 3:
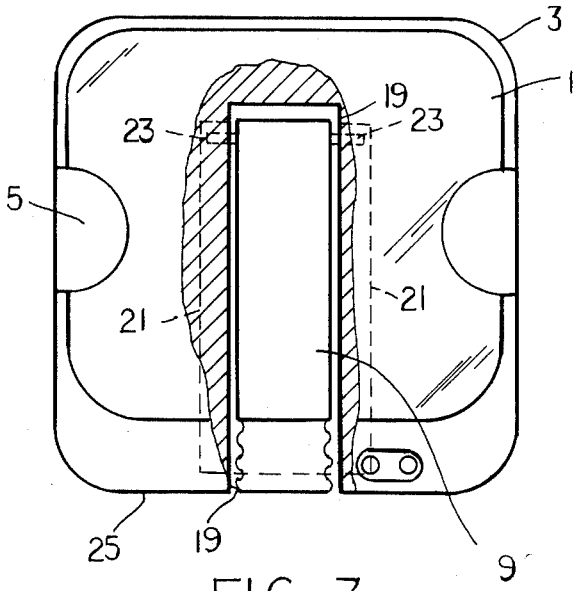
FIG. 3 is a front elevation, partially broken away, of my mirror showing the base support in its withdrawn position.

The mirror of my invention is identified by the numeral 1. It includes hollow mirror housing 3 having side lights 5 and carrying batteries (not shown) for the lights. It has a base support 9 with an end cap 11. Support 9 is slidingly mounted in the recess 19 in housing 3 and is frictionally engaged with the inner surface of recess 19.

Recess 19 is dimensioned to receive and hold base support 9. The sides of recess 19 includes slots or tracks 21 to receive and hold pivot arms 23 which project from the inner end of support 9. Thus, as the base support 9 slides into or from recess 19, pivot arms 23 slide within the slots 21. Slots 21 extend close to, but not all the way to, the outer end of recess 19. As a result, outward movement of base support 9 is limited by the outer ends of the slots 21.

Figure 4:
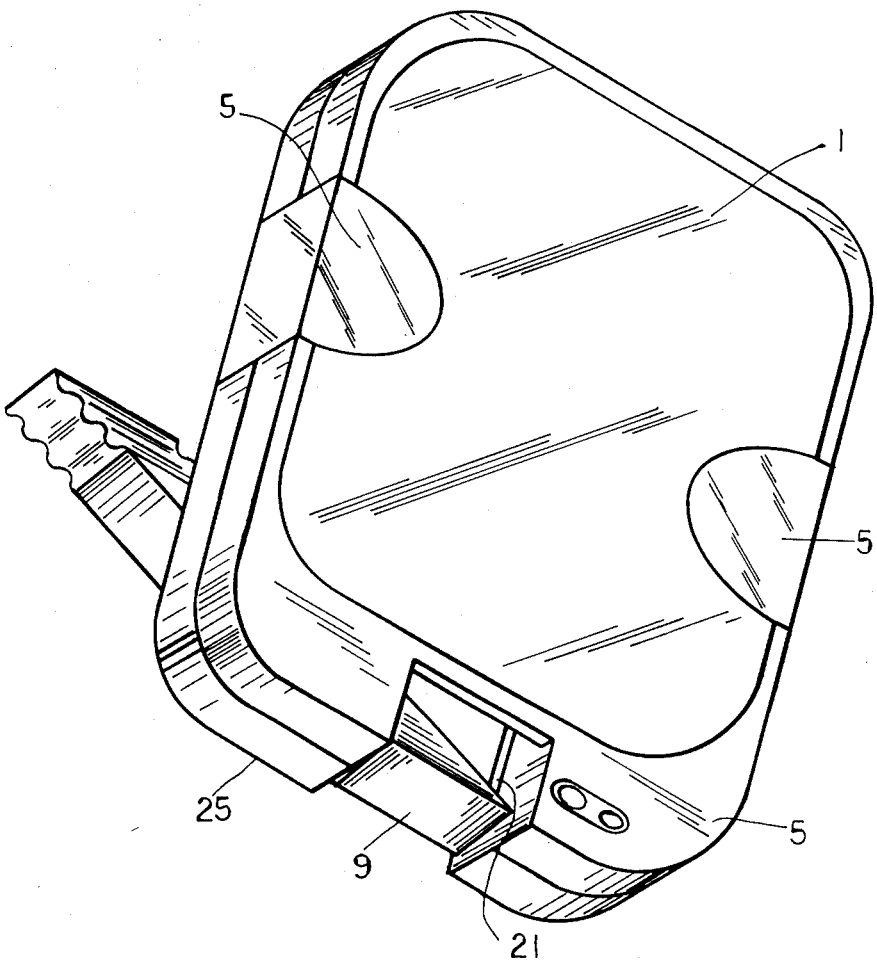
FIG. 4 is a front perspective of my mirror showing the base support extended and pivoted for use as a mirror-supporting base.

When base support 9 is all the way extended, it may be pivoted about arms 23 to a position where it can serve as a stand for the mirror housing 3 (see FIG. 4). Since there is frictional engagement between support 9 and the inner surface of the recess 19, the support 9 can be set at any angle, thus adjusting the angle is positioned when standing. Alternatively, if desired, detents may be used instead of frictional engagement to hold the base support fixed in different positions relative to the housing.

Base support 9 and the lower edge 25 of housing 3 serve to support the mirror and form a stable T-shaped base.

When support 9 is withdrawn from recess 19 but not pivoted, it serves as a handle for the mirror. Thus, support 9 has a dual function.

For storage or travel, support 9 is pushed within recess 19 and left there, held by friction.

I claim:

1. A lighted travel mirror adapted to alternatively stand alone or be hand held, said mirror including a housing, a reflective surface on one side of said housing, said housing carrying at least one light, said housing including a side having a lower edge running substantially the width of said housing, an elongate recess opening to said side of said housing, said recess including slots upon opposing sides thereof, a base support slidingly and frictionally mounted for movement into and out of said recess, said support including pivot arms at the inner end thereof, said pivot arms being operatively engaged with said slots, and the lower end of said base support being flush with said lower edge when said base support is positioned within said housing, whereby said base support may be alternatively stored within said recess or withdrawn from said recess and pivoted so as to form with said lower edge a T-shaped base for said mirror.

2. A lighted travel mirror as set forth in claim 1 in which said slots terminate short of the outer end of said recess, thereby limiting the outward movement of said base support.

3. A lighted travel mirror as set forth in claim 1 in which said base support is adapted to extend straight outwardly from said recess and thereby act as a handle for said mirror, said frictional engagement being sufficient to hold said handle in position for use.

4. A lighted travel mirror as set forth in claim 1 including detents between said base support and said recess for holding said base support fixed in position relative to said housing.

* * * * *